US006494147B1

(12) United States Patent
Schulte et al.

(10) Patent No.: US 6,494,147 B1
(45) Date of Patent: Dec. 17, 2002

(54) COLLAPSIBLE TABLE

(75) Inventors: Robert K. Schulte, Augusta, KS (US); David Hawkins, Wichita, KS (US); Lauren Worley, Wichita, KS (US)

(73) Assignee: The Coleman Company, Inc., Wichita, KS (US)

( * ) Notice: Subject to any disclaimer, the term of this patent is extended or adjusted under 35 U.S.C. 154(b) by 0 days.

(21) Appl. No.: 09/535,768

(22) Filed: Mar. 28, 2000

(51) Int. Cl.[7] ..... A47B 3/00
(52) U.S. Cl. ..... 108/34; 100/77
(58) Field of Search ..... 108/33, 34, 35, 108/77; 297/139

(56) References Cited

U.S. PATENT DOCUMENTS

| | | | | | |
|---|---|---|---|---|---|
| 825,854 | A | | 7/1906 | Mead | |
| 1,457,041 | A | * | 5/1923 | Orear | 297/139 X |
| 1,622,327 | A | * | 3/1927 | Livingood | 297/139 |
| 1,881,095 | A | * | 10/1932 | Penrose | |
| 1,964,789 | A | * | 7/1934 | MacDonald | 297/139 |
| 1,992,434 | A | * | 2/1935 | Kosanek | 297/139 X |
| 2,109,869 | A | * | 3/1938 | Ross | 297/139 X |
| 2,154,125 | A | * | 4/1939 | Dillon | |
| 2,226,710 | A | * | 12/1940 | Daniel | 108/35 |
| 2,279,122 | A | * | 4/1942 | Kovalchuk | 297/139 X |
| 2,457,411 | A | * | 12/1948 | Steinberger | 108/34 X |
| 2,563,891 | A | | 8/1951 | Wallance | |
| 2,639,761 | A | * | 5/1953 | Schenzinger et al. | |
| 2,991,829 | A | * | 7/1961 | Post | 297/139 |
| 3,606,845 | A | * | 9/1971 | Hickman | |
| 4,223,945 | A | * | 9/1980 | Nikitits | 297/139 X |
| 4,229,038 | A | * | 10/1980 | Drost | 297/139 |

OTHER PUBLICATIONS

Linon Home Decor Products, Inc. Assembly Instructions Model #909 Table, Jan. 25, 1999.

* cited by examiner

*Primary Examiner*—Jose V. Chen
(74) *Attorney, Agent, or Firm*—Leydig, Voit & Mayer, Ltd.

(57) ABSTRACT

A collapsible table includes an integrated storage space for folding chairs. The storage space is formed by an open frame base that is not enclosed with side panels or a floor panel. The open frame configuration thus prevents the accumulation of rain water inside the storage area and makes the table better suited for outdoor recreational use. The table includes a center leaf having an opening into which a table umbrella may be inserted to shade users from sun and rain. Rubber bumpers may be placed along one of the sides of the table to allow a user to store the table on that side without fear of damaging the table, providing a user with more choices as far as storage space is concerned. Side leaves are also included and designed to releasably lock in the folded position, facilitating transportation and storage without the threat of the leaves swinging open unexpectedly.

20 Claims, 13 Drawing Sheets

COLLAPSIBLE TABLE

FIELD OF THE INVENTION

The present invention relates to collapsible Lables, specifically to collapsible tables with integrated storage compartments.

BACKGROUND INFORMATION

Collapsible tables have a wide variety of uses, especially in recreational settings outdoors. Most known designs for collapsible tables concentrate on achieving the smallest possible folded package.

Convenience in storage, however, is not always increased by simply making the folded package more compact. For example, although collapsible tables are very often used in conjunction with folding chairs, most known designs for collapsible tables fail to integrate storage space for folding chairs.

Furthermore, even those known collapsible tables that include integrated storage space for folding chairs are not well designed for outdoors use. They lack, for example features that take into account the accumulation of rain water in the storage area, or protection for users of the table from the sun or the rain.

Additionally, known collapsible tables with integrated storage are often designed to stand only on their legs when in the folded position. Such collapsible tables may either be damaged by being stored, for example, on one of its sides or lack a side leaf lock that will lock the leaves of the table in the lowered position. However, the ability to store a collapsible table on its side would be very desirable, as this adds to the ease with which the table may be stored.

SUMMARY OF THE INVENTION

The present invention provides a collapsible table that overcomes known problems in the art. The table of the present invention comprises an integrated storage space for folding chairs. The storage space is not enclosed with side panels or a floor panel. It is in the form of an open frame base and thus prevents the accumulation of rain water inside the storage area and makes the table better suited for outdoor recreational use. The table's center leaf further includes an opening into which a table umbrella may be inserted, which serves to shade users from sun and rain.

The present invention also provides rubber bumpers along one of the sides of the table, which allow a user to store the table on that side without fear of damaging the table. This provides a user with more choices as far as storage space is concerned.

The side leaves are also designed to releasably lock in the folded position. Thus, the table may be transported or stored on its side more easily without the threat of the leaves swinging open unexpectedly.

DETAILED DESCRIPTION OF THE INVENTION

Various aspects of the present invention will be described, and for purposes of explanation, specific configurations and details are set forth in order to provide a thorough understanding of the present invention. However, it will be apparent to one skilled in the art that the present invention may be practiced without these specific details. Furthermore, well known features have been omitted or simplified in order to prevent obscuring the present invention.

Figure 1:
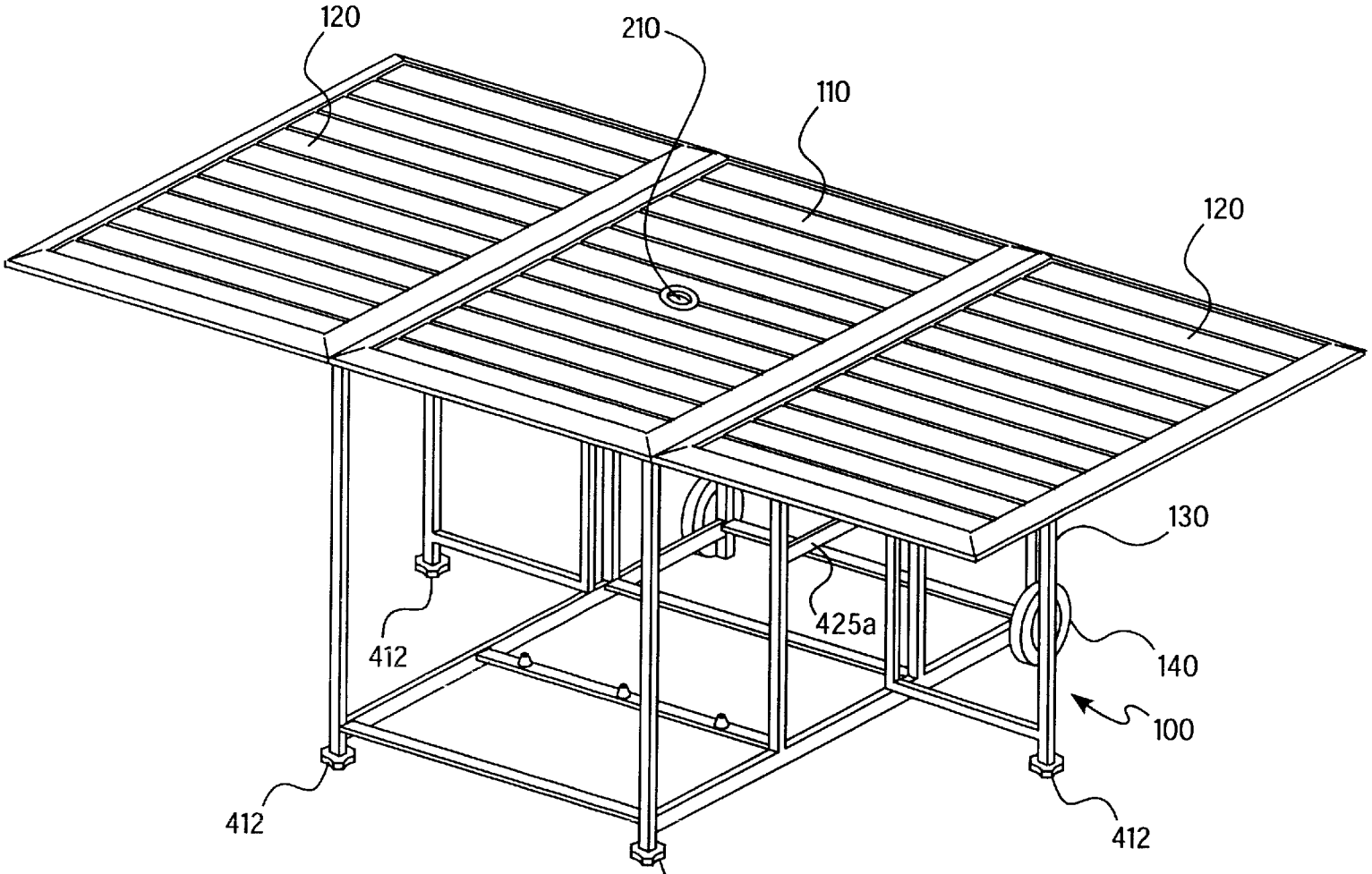
FIG. 1 illustrates a perspective view of a collapsible table in the unfolded state according to an exemplary embodiment of the present invention.
Figure 2:
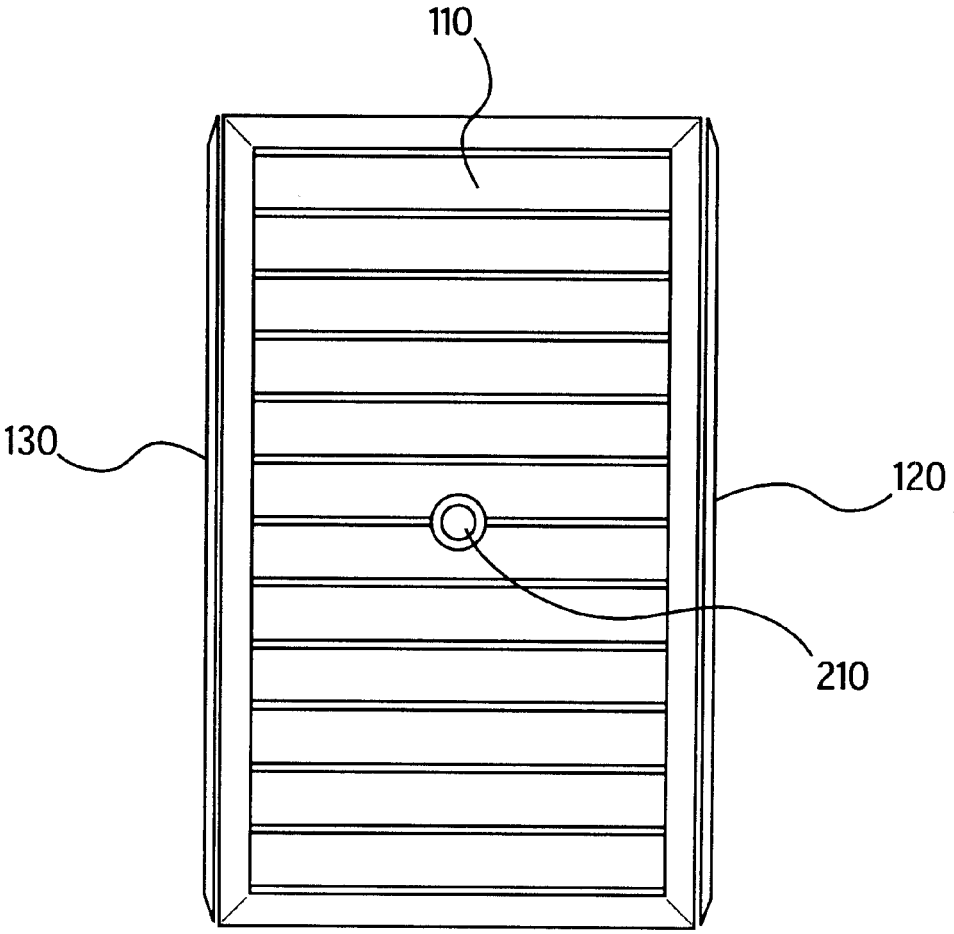
FIG. 2 illustrates a top view of a collapsible table in the folded state according to an exemplary embodiment of the present invention.

FIG. 1 illustrates a front view of a collapsible table 100 in an unfolded state according to an exemplary embodiment of the present invention. FIG. 2 illustrates a top view of a collapsible table 100 in the folded state according to an exemplary embodiment of the present invention. Referring to FIGS. 1 and 2, side leaves 120 may be constructed, for example, from aluminum, and are conventionally hinged to a center leaf 110. Center leaf 110 may also be constructed, for example, from aluminum. Side leaves 120 are movable between a raised position, depicted in FIG. 1, and a lowered position, depicted in FIG. 2. In its unfolded state, collapsible table 100 has, for example, side leaves 120 in a raised position, disposed laterally to center leaf 110 and forming a planar table surface with center leaf 110.

Referring to FIG. 2, according to an exemplary embodiment of the present invention, an umbrella support opening 210 is provided in center leaf 110 into which a table umbrella may be inserted and supported.

Figure 4A:
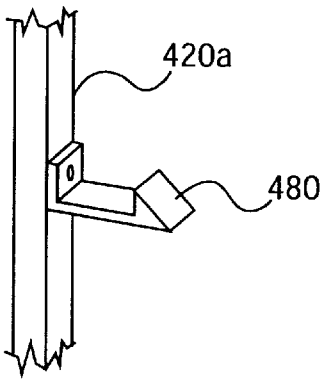
FIG. 4*a* illustrates an enlarged detail view of a side leaf lock of a collapsible table according to an exemplary embodiment of the present invention.
Figure 4:
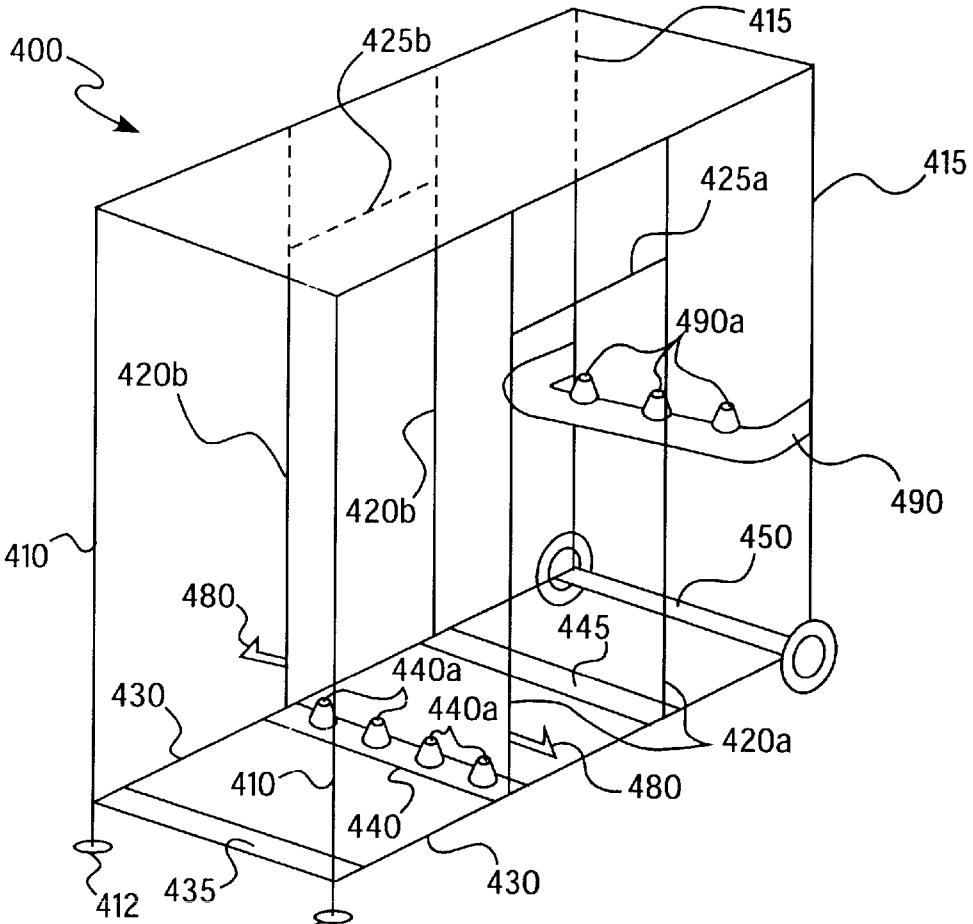
FIG. 4 illustrates a perspective view of a frame base of a collapsible table according to an exemplary embodiment of the present invention.
Figure 5:
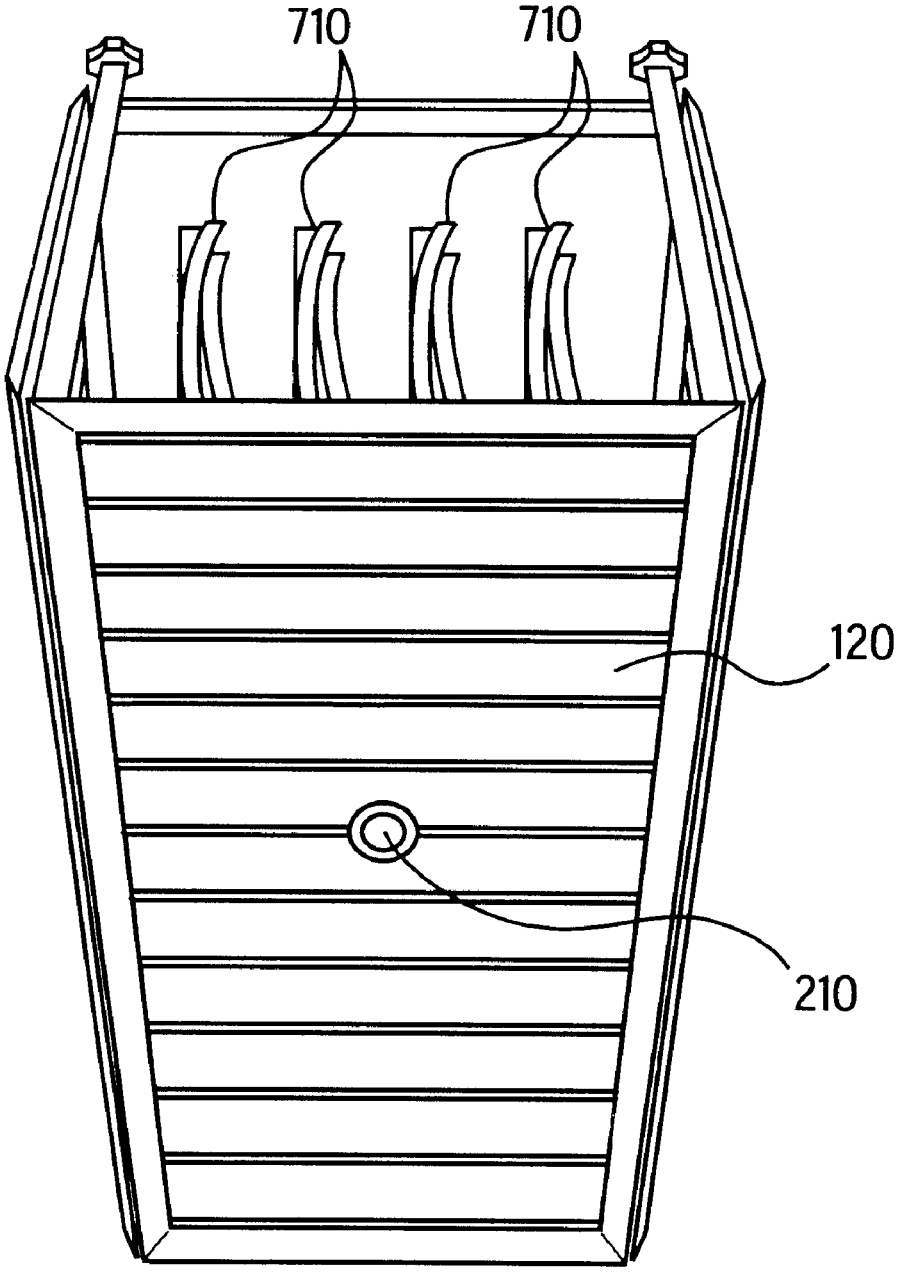
FIG. 5 illustrates a top perspective view of a collapsible table in the folded state according to an exemplary embodiment of the present invention.
Figure 7:
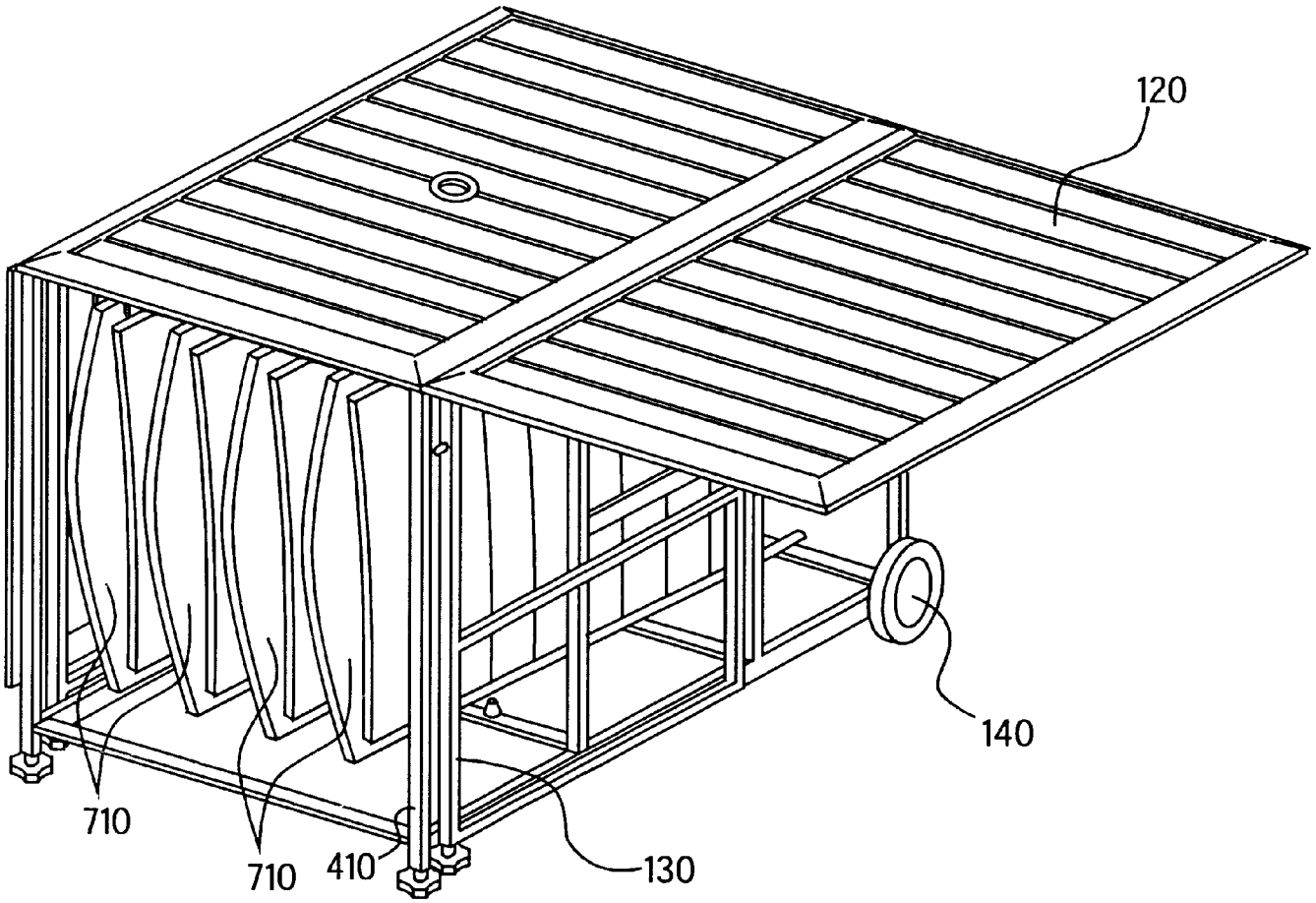
FIG. 7 illustrates a side perspective view of a collapsible table with support arms in a folded state according to an exemplary embodiment of the present invention.

FIG. 4 depicts a collapsible table 100 omitting side leaves 120 and support arms 130, so that frame base 400 may be seen more clearly. In this embodiment, a frame base 400 supports table leaves 110, 120. Frame base 400 serves, for example, two purposes: (i) it provides support for table leaves 110, 120; and (ii) it provides a storage area for folding chairs 710 as depicted in FIG. 7.

In this exemplary embodiment of the present invention, frame base 400 is comprised of a plurality of horizontal and vertical support members constructed from, for example, aluminum, and arranged in a rectangular box-shaped frame. Referring to FIG. 4, the respective top ends of front vertical supports 410, rear vertical supports 415, and side vertical supports 420*a–b* are, for example, connected to center leaf 110 and their respective approximate bottom ends are connected, for example, to lower horizontal supports 430. In the present embodiment, wheels 140 are pivotally coupled to the rear portion of lower horizontal supports 430.

Figure 8:
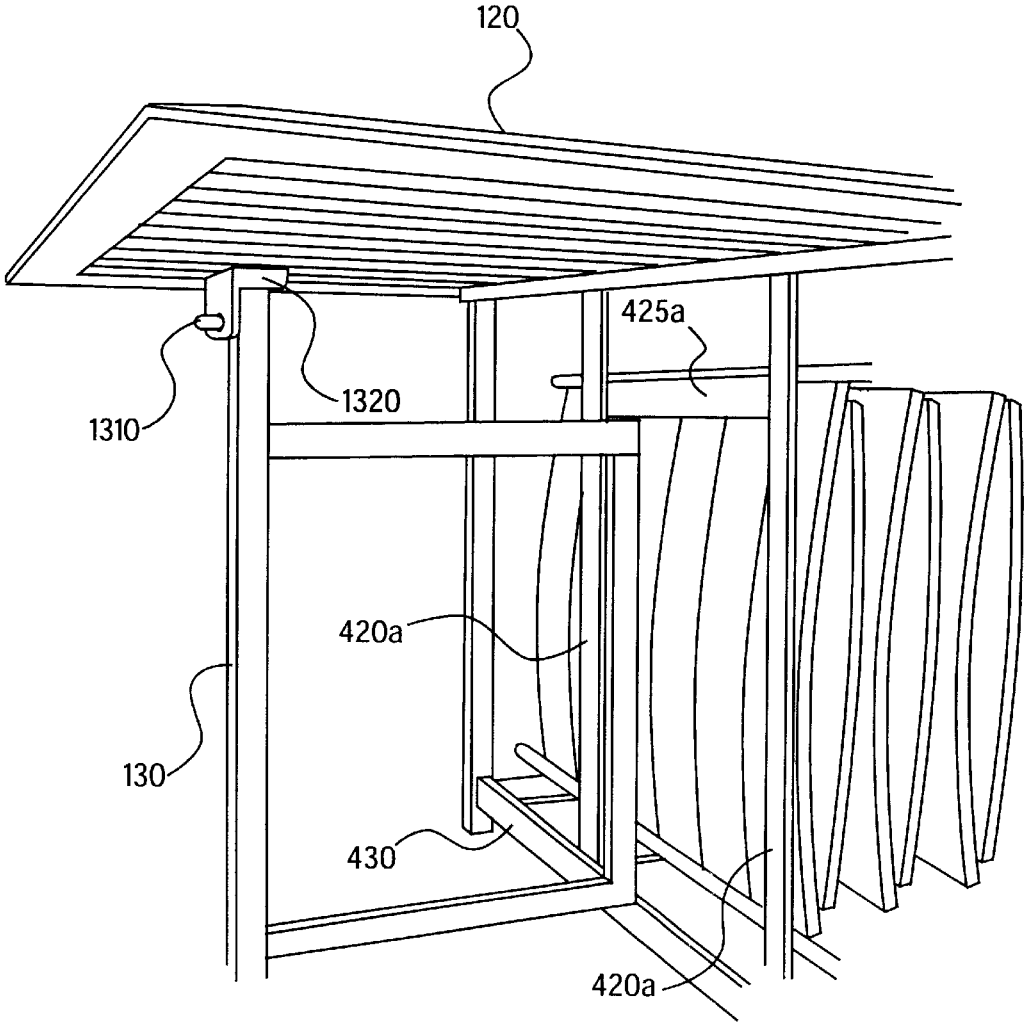
FIG. 8 illustrates a side perspective view of a collapsible table with a support arm in an unfolded state according to an exemplary embodiment of the present invention.
Figure 9:
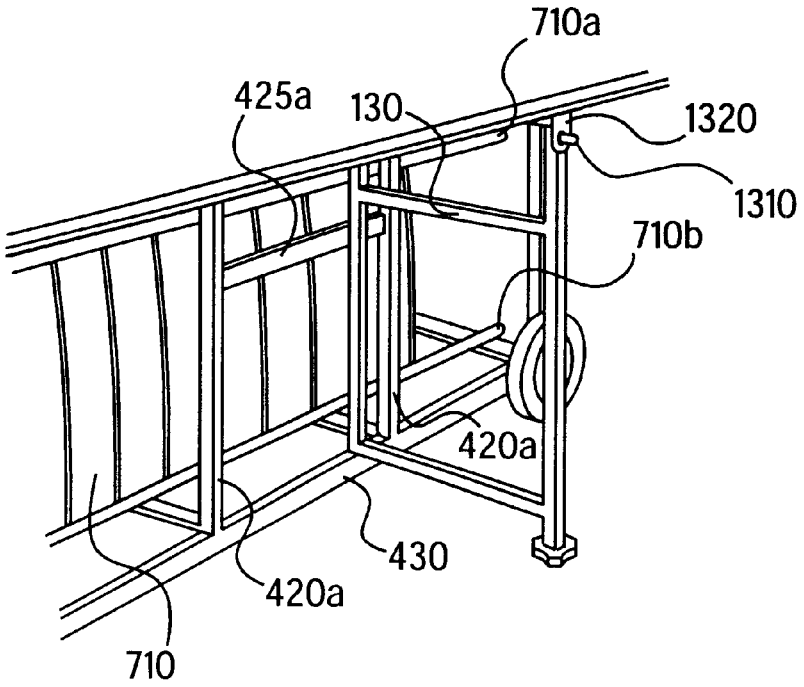
FIG. 9 illustrates a side perspective view of a collapsible table in an unfolded state, according to an exemplary embodiment of the present invention.
Figure 10:
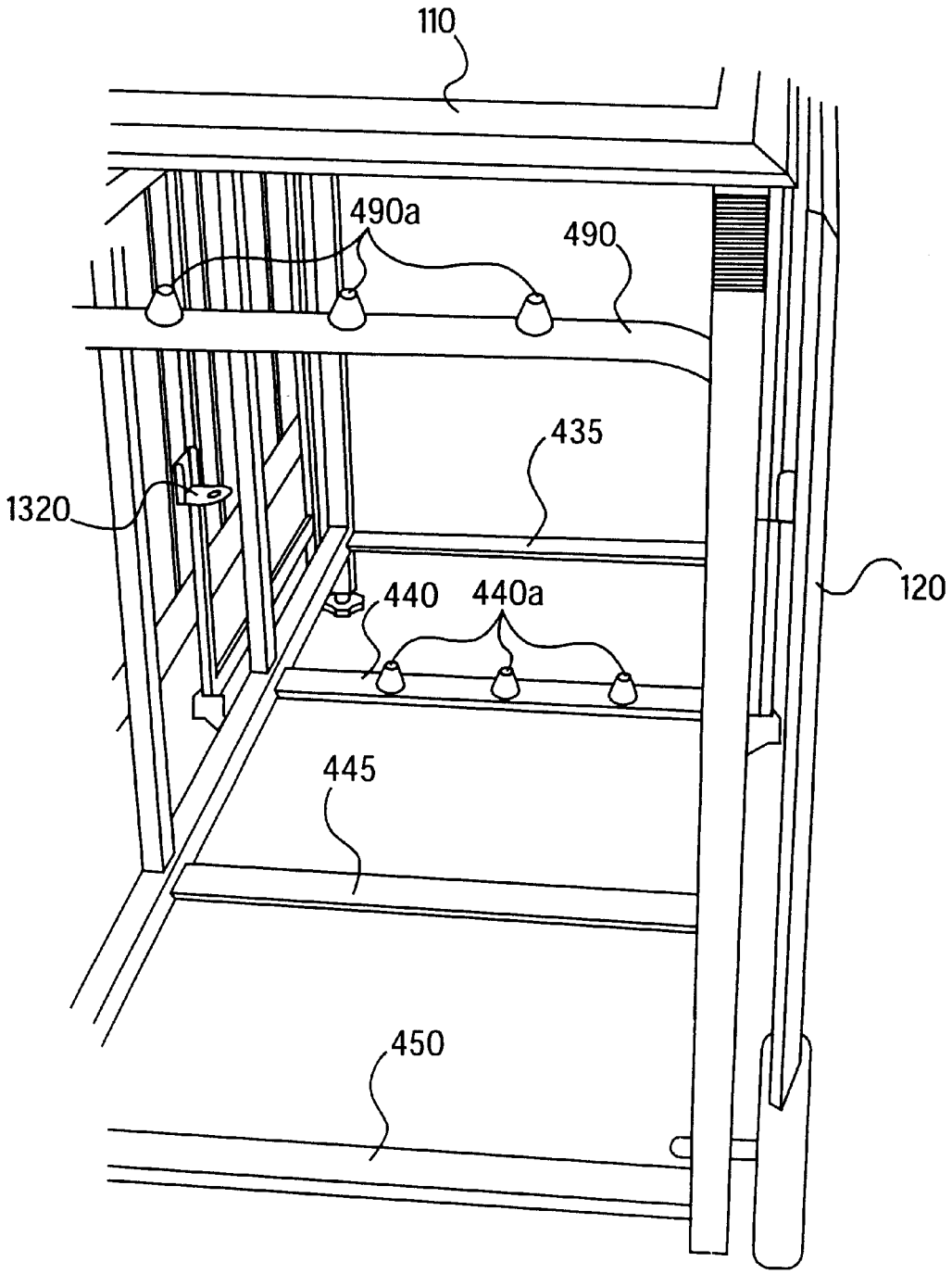
FIG. 10 illustrates a rear perspective view of a collapsible table in a folded state according to an exemplary embodiment of the present invention.
Figure 11:
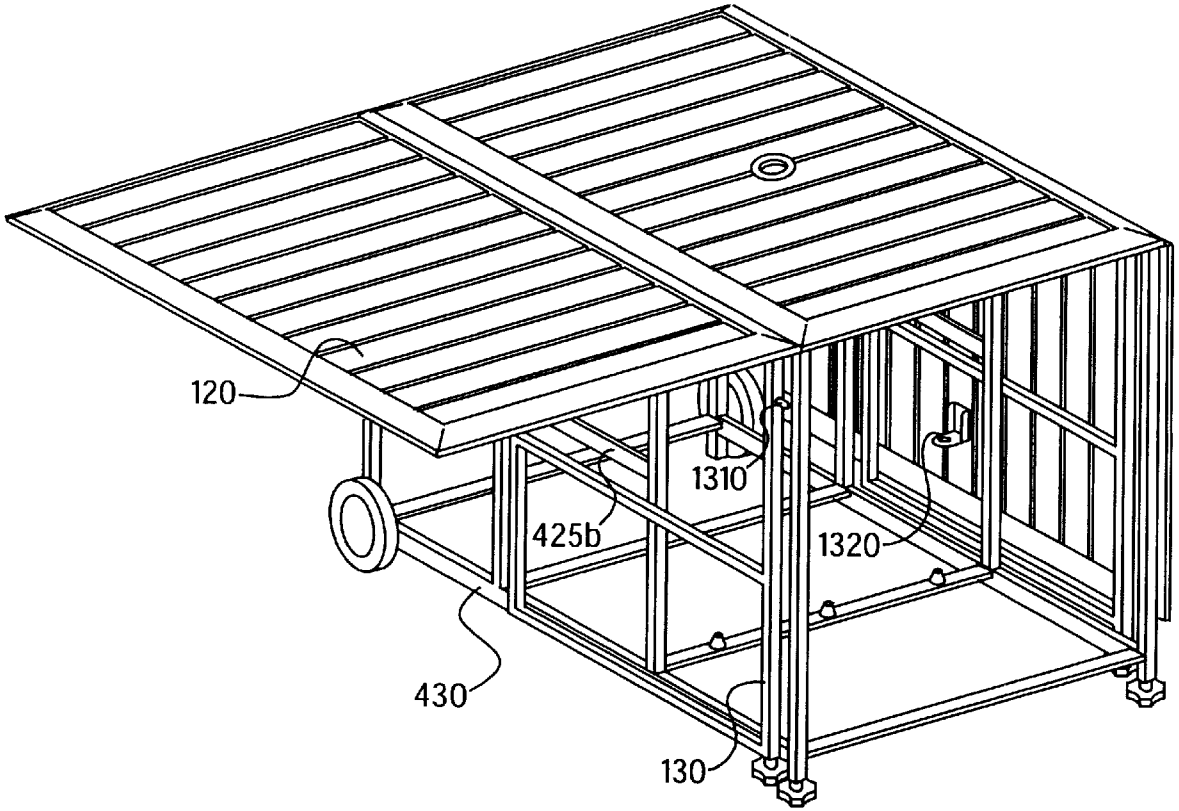
FIG. 11 illustrates a side perspective view of a collapsible table with one support arm in a folded state according to an exemplary embodiment of the present invention.

Referring to FIGS. 4, 8, and 9, upper horizontal supports 425*a–b* are connected at either end to a pair of side vertical supports 420*a* and 420*b* respectively. In this embodiment, the upper ends of support arms 130 are pivotally connected to the upper horizontal supports 425*a–b* and the lower ends are pivotally connected to the lower horizontal supports 430. Support arms 130 are constructed, for example, from aluminum and are movable between a folded position depicted in FIGS. 7, 10, and 11 and an unfolded position depicted in FIGS. 1, 8, and 9.

In the unfolded position support arms 130 are displaced substantially perpendicular to both upper and lower horizontal supports 425*a–b,* 430 and also substantially perpendicular to and directly underneath side leaves 120. In the unfolded position, support arms 130 hold side leaves in the raised position as depicted in FIG. 1.

Figure 12:
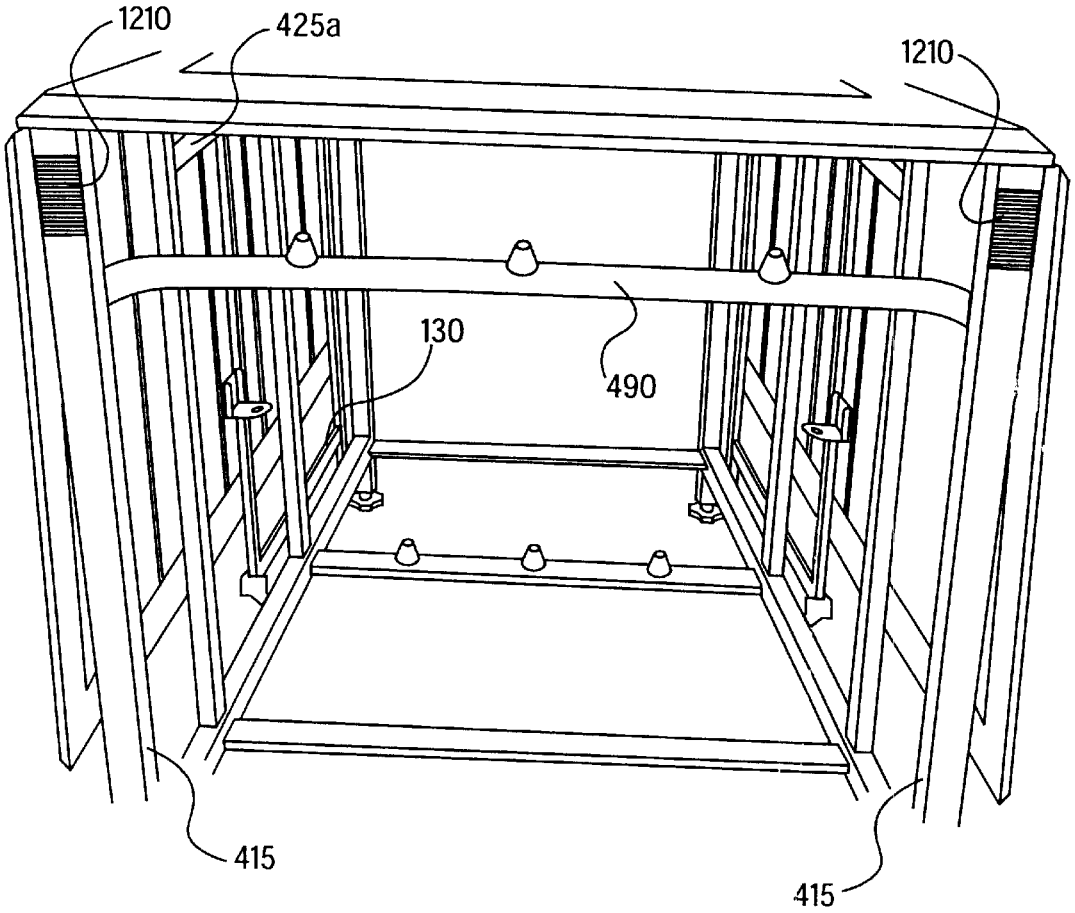
FIG. 12 illustrates a close-up perspective view of a stop bar of a collapsible table according to an exemplary embodiment of the present invention.

Referring to FIGS. 7 and 12, in the folded position, support arms 130 are substantially parallel to both upper and lower horizontal supports 425*a–b,* 430 and also substantially parallel to side leaves 120. In the folded position, support arms 130 allow leaves to fall to the lowered position.

Figure 13:
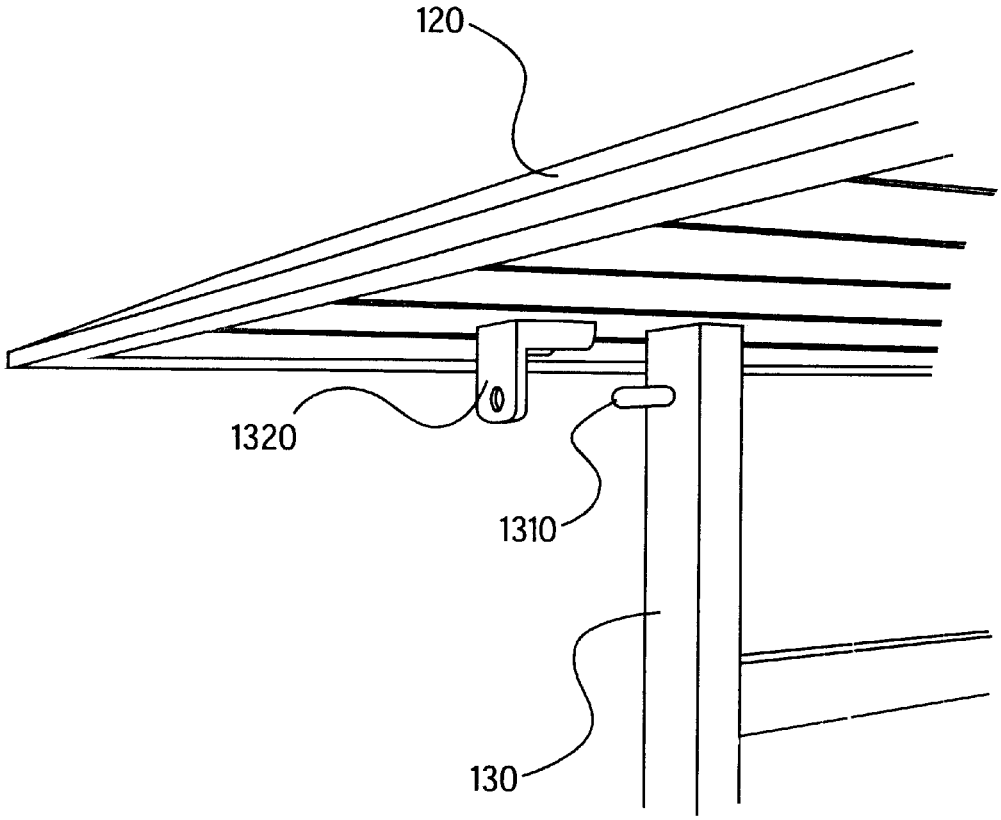
FIG. 13 illustrates a close-up perspective view of an arm lock of a collapsible table according to an exemplary embodiment of the present invention.

Support arms 130 are releasably lockable in the unfolded position. Referring to FIGS. 8, 9, and 13 each support arm 130 includes, for example, an arm lock 1310. In this embodiment, arm lock 1310 is a depressible spring-loaded button coupled to an upper portion of support arm 130. Arm lock 1310 fits, for example, into a corresponding opening 1320*a* in a lock bracket 1320. Lock bracket 1320 is, for example, connected to a bottom center portion of each of the side leaves 120. In the present embodiment, when a support arm 130 is moved to the unfolded position, arm lock 1310 is brought into contact with the corresponding lock bracket 1320. This contact causes, for example, arm lock 1310 to be depressed until arm lock 1310 reaches opening 1320*a* in lock bracket 1320. In this embodiment, spring action pushes arm lock 1310 into opening 1320*a* of lock bracket 1320, locking the corresponding support arm 130 in the unfolded position. To release a support arm 130 from the unfolded position, the corresponding arm lock 1310 is depressed which allows the support arm 130 to be moved to the folded position.

Side leaves are, for example, releasably lockable in the lowered position. Referring to FIGS. 4 and 4*a,* two or more side leaf locks 480 are, for example, connected to side vertical supports 420*a–b*. In the present embodiment, side leaf lock 480 is made, for example, from plastic or some other flexible material, and has a barbed end. As side leaf 120 is moved into the lowered position, side leaf lock 480 flexes and hooks onto the lowest edge of side leaf 120.

Figure 3:
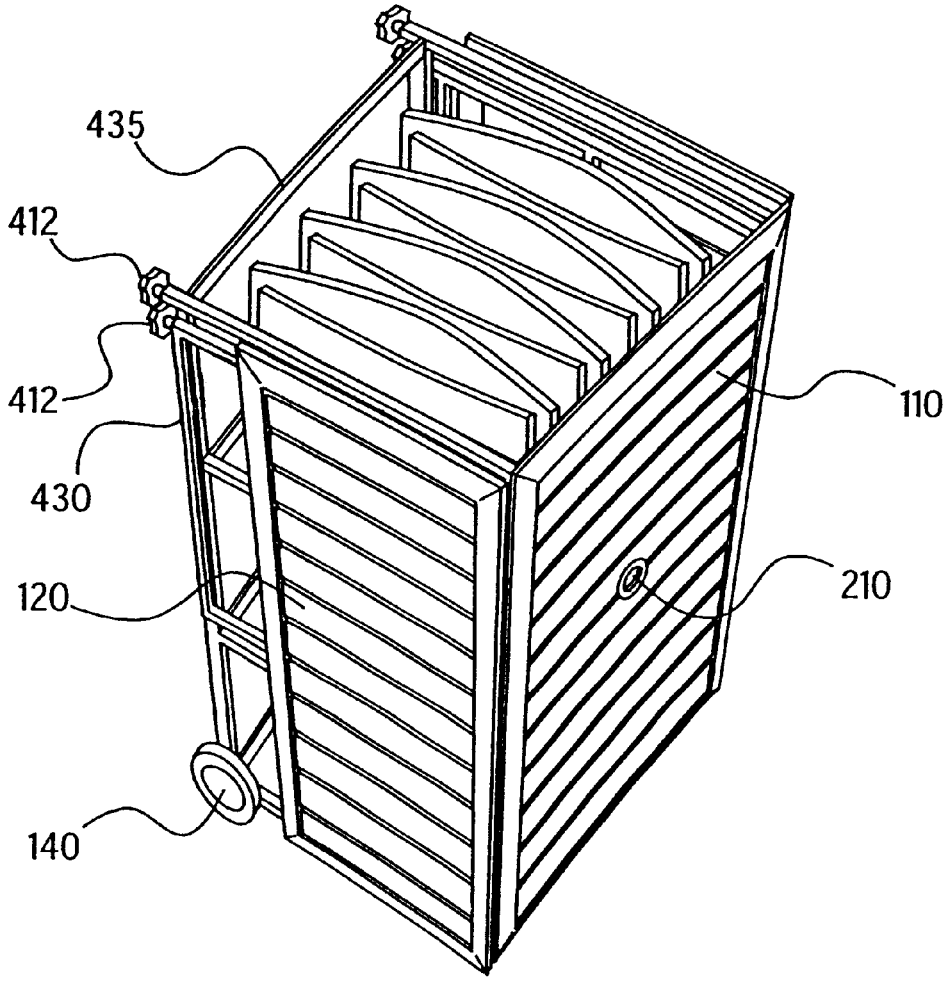
FIG. 3 illustrates a side perspective view of a collapsible table in the folded state according to an exemplary embodiment of the present invention.

A side leaf 120 may only be moved to the lowered position if the corresponding support arm 130 is already in the folded position. Thus, locking a side leaf 120 in the lowered position also locks the corresponding support arm 130 in the folded position. Locking side leaves 120 in the lowered position creates a stable folded package for collapsible table 100, and is especially helpful, for example, when moving collapsible table 100 or when collapsible table 100 is laid on its rear side as depicted in FIG. 3.

Figure 6:
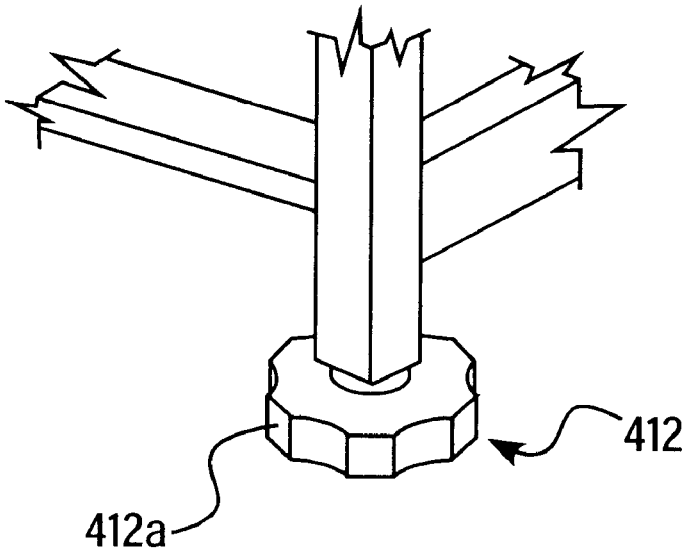
FIG. 6 illustrates a close-up view of an adjustable foot according to an exemplary embodiment of the present invention.

FIG. 6 illustrates a close-up view of an adjustable foot according to an exemplary embodiment of the present invention. Referring to FIGS. 1 and 6, front vertical supports 410 and support arms 130 include, for example, adjustable feet 412. Each adjustable foot 412 includes, for example, a threaded shaft 412*a* that in the present embodiment is screwed into and out of a corresponding threaded portion inside a front vertical support 410 or a support arm 130. Screwing an adjustable foot 412 into front vertical support 410 or support arm 130 decreases the height of the front vertical support 410 or support arm 130. Similarly, unscrewing an adjustable foot 412 out from a front vertical support 410 or a support arm 130 increases the height of the front vertical support 410 or support arm 130. Thus one may adjustably level collapsible table 100 by screwing or unscrewing the adjustable feet 412.

Referring to FIG. 12, bumpers 1210, in this embodiment, are attached to rear vertical supports 415 and may be made, for example, from rubber. In this exemplary embodiment of the present invention, one may store collapsible table 100 by resting collapsible table 100 on rear vertical supports 415 as depicted in FIG. 3. Bumpers 1210 protect rear vertical supports 415 from damage when laying collapsible table 100 on rear vertical supports 415 as depicted in FIG. 3.

In this exemplary embodiment, bottom cross-members 435, 450, 440, 445 are coupled at either end to side horizontal supports 430 as shown in FIG. 4. Bottom cross-members 435, 450, 440, 445 are, for example, disposed perpendicularly to side horizontal supports 430 and are also disposed parallel to one another and evenly spaced. Bottom cross-member 435 is, in this embodiment, disposed closest to front vertical supports 410 and bottom cross-member 450 is disposed closest to rear vertical supports 415.

In this exemplary embodiment, bottom cross-member 440 has chair guides 440*a* evenly spaced and made, for example, from injection molded plastic. The spaces between adjacent chair guides 440*a* are, for example, wide enough for a folding chair 710 to fit through when laying on its side in the folded position.

A stop rail 490, made for example, from aluminum, is coupled at either end to an upper portion of a rear vertical support 415. In this exemplary embodiment, stop rail 490 has stop rail chair guides 490*a,* made from injection molded plastic and evenly spaced. As with chair guides 440*a,* the spaces between adjacent guides 490*a* are, for example, wide enough for a folding chair 710 to fit through if on its side in the folded position.

In this exemplary embodiment, frame base 400 is used to store folding chairs 710 as depicted in FIGS. 5, 7, 8, and 9. A folding chair 710 in the folded position is placed, for example, on one side and inserted through the open front end. In this exemplary embodiment, the folding chairs 710 are made to slide along bottom slats 435, 440, 445, 450 and through the open space between bottom slat chair guides 440*a*.

Referring to FIG. 9, stop bar 490 prevents folding chairs 710 from sliding through the open rear end of collapsible table 100. Upper legs 710*a* of folding chairs 710 slide onto stop bar 490, fitting through the space between the stop bar chair guides. Folding chairs 710 are fully inserted in the storage area of collapsible table 100 when the folding chair rung 710*b* comes into contact with the stop bar 490. Thus, bottom slat chair guides 440*a* and the stop bar chair guides 490*a* work together to limit movement of folding chairs 710 during transport or storage of collapsible table 100.

What is claimed is:

1. A table, comprising:

a frame base having a top horizontal side, a first vertical side, a second vertical side, a third vertical side, and a fourth vertical side, the top horizontal side having a base length and a base width, and the vertical sides having a base height; a stationary center leaf member coupled to the top horizontal side of the frame base, the stationary center leaf member having a center leaf member length approximately equal to the base length and having a center leaf member width approximately equal to the base width;

a movable side leaf member laterally disposed adjacent the first vertical side and movably connected to the stationary center leaf member, the side leaf member having a side leaf member length approximately equal to the base length;

a movable support arm member adjacent the side leaf member, the movable support arm member having a support arm member height approximately equal to the base height;

first chair guides, positioned at a bottom portion of the frame base, for separating chairs that are aligned vertically in the frame base;

second chair guides, spaced from the bottom portion of the frame base, for separating chairs that are aligned vertically in the frame base; and a stop, positioned at one end of the frame base, for preventing chairs that are aligned vertically in the frame base from moving downward when the frame base is positioned on the one end.

2. The table, according to claim 1, wherein the frame base comprises a plurality of rectangular frame members arranged in a box-like structure.

3. The table, according to claim 2, wherein the plurality of rectangular frame members comprises two or more substantially horizontal support members rigidly coupled to two or more substantially vertical support members.

4. The table, according to claim 3, wherein the support arm member is pivotally connected in a vertical fashion to the first vertical side of the frame base.

5. The table, according to claim 4, wherein the side leaf member is movable between a raised position and a lowered position, and wherein the support arm member is movable between an unfolded position and a folded position, and wherein the support arm member in the unfolded position holds the side leaf member in the raised position, and wherein the support arm member in the folded position permits the side leaf member to move to the lowered position.

6. The table according to claim 5, wherein the support arm member includes an adjustable foot.

7. The table according to claim 6 wherein two or more vertical support members include adjustable feet.

8. The table according to claim 7, wherein the support arm member is releasably lockable in the unfolded position.

9. The table according to claim 4 wherein the side leaf member is releasably lockable in the lowered position.

10. The table according to claim 1 comprising an opening in the center leaf to receive an umbrella.

11. The table according to claim 1 wherein the stop comprises a bar to fit against chair rungs of chairs that are aligned vertically in the frame base.

12. The table according to claim 1 wherein the frame base comprises two or more vertical support members with bumper members coupled to at least one of the vertical support members.

13. The table according to claim 1 further comprising a pair of wheels attached to the frame base at rear corners of a bottom horizontal side.

14. The table according to claim 13 wherein the pair of wheels are of a diameter that permits the table to be rolled when held diagonally, but allows the table to be level when resting on the ground.

15. A table and chair combination comprising:

a frame base having a top horizontal side, a bottom horizontal side, a front vertical side, a back vertical side, a left vertical side, and a right vertical side, the top and bottom horizontal sides having a base length and a base width, and the vertical sides having a base height; a stationary center leaf member coupled to the top horizontal side of the frame base, the stationary center leaf member having a center leaf member length approximately equal to the base length and having a center leaf member width approximately equal to the base width; a movable side leaf member laterally disposed adjacent one of the left and right vertical sides and movably connected to the stationary center leaf member, the side leaf member having a side leaf member length approximately equal to the base length;

a movable support arm member adjacent the side leaf member, the movable support arm having a support arm member height approximately equal to the base height;

first chair guides, positioned at a bottom portion of the frame base, for separating chairs that are aligned vertically in the frame base;

second chair guides, spaced from the bottom portion of the frame base, for separating chairs that are aligned vertically in the frame base;

a stop, positioned at one end of the frame base, for preventing chairs that are aligned vertically in the frame base from moving downward when the frame base is positioned on the one end; and a folding chair having a folded chair length approximately equal to the base length and a folded chair width less than the side leaf member height such that the folding chair in a folded position lying on a lateral edge fits within the frame base between the top and bottom horizontal sides, against the stop, and between pairs of the first and second chair guides.

16. A table, comprising:

a box frame having a pair of wheels attached to the box frame at rear comers of a bottom horizontal side;

a stationary center leaf member coupled to the box frame;

a movable side leaf member laterally disposed and movably connected to the stationary center leaf member;

first chair guides, positioned at a bottom portion of the box frame, for separating chairs that are aligned vertically in the frame base;

second chair guides, spaced from the bottom portion of the box frame, for separating chairs that are aligned vertically in the frame base;

a stop, positioned at one end of the box frame, for preventing chairs that are aligned vertically in the frame base from moving downward when the frame base is positioned on the one end; and a movable support arm member.

17. The table, according to claim 16, wherein the support arm member is pivotally connected in a vertical fashion to a first vertical side of the box frame.

18. The table according to claim 17, wherein the support arm member includes an adjustable foot.

19. The table according to claim 16, wherein the side leaf member is releasably lockable in a lowered position.

20. The table according to claim 16 comprising an opening in the center leaf to receive an umbrella.

* * * * *